United States Patent [19]

Shishoo et al.

[11] 3,961,458

[45] June 8, 1976

[54] PRETREATMENT, PACKING, STORING AND FINISHING TREATMENT OF TEXTILE MATERIAL PRODUCTS

[75] Inventors: Roshan Lal Shishoo, Askim; Erik Malte Lundell, Molnlycke, both of Sweden

[73] Assignee: Svenska Textilforskningsinstitutet, Goteborg, Sweden

[22] Filed: June 25, 1975

[21] Appl. No.: 590,170

[30] Foreign Application Priority Data

July 5, 1974 Sweden ..... 7408871

[52] U.S. Cl. ..... 53/21 FC; 34/12; 223/51

[51] Int. Cl.[2] ..... B65B 31/02; B65B 25/20

[58] Field of Search ..... 53/21 FC, 21 R, 22 B, 53/25; 34/12, 13; 19/66 CC; 28/21, 72 R; 38/144; 223/51

[56] References Cited

UNITED STATES PATENTS

| | | | |
|---|---|---|---|
| 2,174,215 | 9/1939 | Rose | 38/144 X |
| 2,848,146 | 8/1958 | Kronsbein | 223/51 |
| 2,951,007 | 8/1960 | Lippke | 34/12 X |
| 3,188,779 | 6/1965 | Elden | 53/21 FC |
| 3,720,037 | 3/1973 | Jones | 53/21 FC |
| 3,752,373 | 8/1973 | Smith | 223/51 |

*Primary Examiner*—Travis S. McGehee
*Assistant Examiner*—Horace M. Culver
*Attorney, Agent, or Firm*—Pollock, Vande Sande & Priddy

[57] ABSTRACT

Process for reducing wrinkling of textile products at storing or transport comprising conditioning in air at a R.H. of 0–30% and at 25°C, enclosing in moisture-proof material, evacuating the package, storing at a temperature not higher than 30°C, opening the package and reconditioning in an unloaded state at a R.H. of at least 55% and at 20°–45°C, preferably after a first reconditioning at a R.H. of at most 35% and at 25°C.

7 Claims, 8 Drawing Figures a.) PRECONDITIONING: 1 WEEK AT 15% RELATIVE HUMIDITY AND 23°C
STORAGE: WRINKLED FOR 1 WEEK UNDER LOAD AT ROOM TEMPERATURE
RECOVERY: FOR 1 WEEK AT 15% RELATIVE HUMIDITY AND 23°C b.) SEE a.), IN ADDITION FOR THESE SAMPLES
RECOVERY: FOR 1 WEEK AT 65% RELATIVE HUMIDITY AND 23°C c.) PRECONDITIONING: 1 WEEK AT 15% RELATIVE HUMIDITY AND 23°C
STORAGE: WRINKLED FOR 1 WEEK UNDER LOAD AT ROOM TEMPERATURE
RECOVERY: FOR 1 WEEK AT 65% RELATIVE HUMIDITY AND 23°C d.) PRECONDITIONING: 1 WEEK AT 65% RELATIVE HUMIDITY AND 23°C
STORAGE: WRINKLED FOR 1 WEEK UNDER LOAD AT ROOM TEMPERATURE
RECOVERY: FOR 1 WEEK AT 15% RELATIVE HUMIDITY AND 23°C e.) SEE d.), IN ADDITION FOR THESE SAMPLES
RECOVERY: FOR 1 WEEK AT 65% RELATIVE HUMIDITY AND 23°C f.) PRECONDITIONING: 1 WEEK AT 65% RELATIVE HUMIDITY AND 23°C
STORAGE: WRINKLED FOR 1 WEEK UNDER LOAD AT ROOM TEMPERATURE
RECOVERY: FOR 1 WEEK AT 65% RELATIVE HUMIDITY AND 23°C

FIG. 1
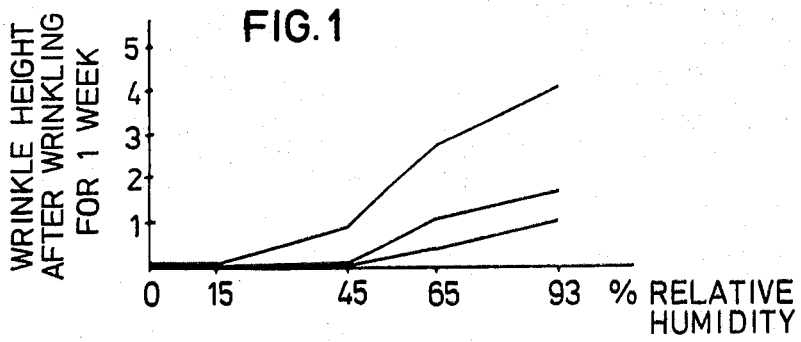
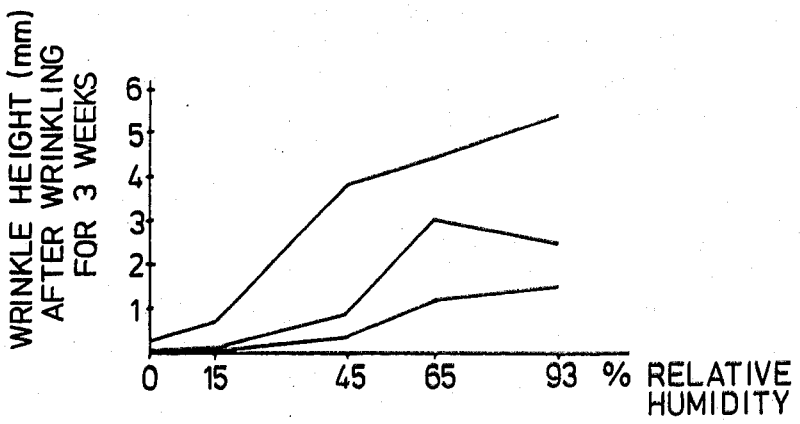
FIG. 2

FIG. 3

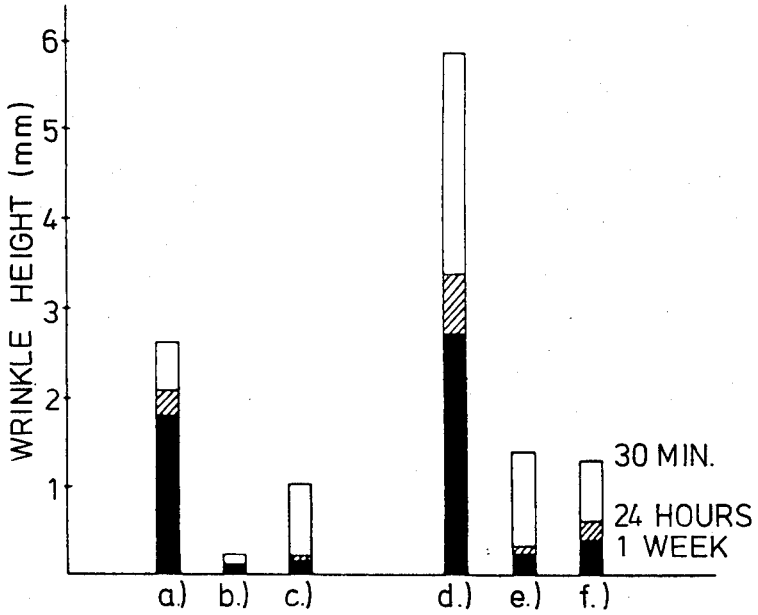

a.) PRECONDITIONING: 1 WEEK AT 15% RELATIVE HUMIDITY AND 23°C
STORAGE: WRINKLED FOR 1 WEEK UNDER LOAD AT ROOM TEMPERATURE
RECOVERY: FOR 1 WEEK AT 15% RELATIVE HUMIDITY AND 23°C b.) SEE a.). IN ADDITION FOR THESE SAMPLES
RECOVERY: FOR 1 WEEK AT 65% RELATIVE HUMIDITY AND 23°C c.) PRECONDITIONING: 1 WEEK AT 15% RELATIVE HUMIDITY AND 23°C
STORAGE: WRINKLED FOR 1 WEEK UNDER LOAD AT ROOM TEMPERATURE
RECOVERY: FOR 1 WEEK AT 65% RELATIVE HUMIDITY AND 23°C d.) PRECONDITIONING: 1 WEEK AT 65% RELATIVE HUMIDITY AND 23°C
STORAGE: WRINKLED FOR 1 WEEK UNDER LOAD AT ROOM TEMPERATURE
RECOVERY: FOR 1 WEEK AT 15% RELATIVE HUMIDITY AND 23°C e.) SEE d.). IN ADDITION FOR THESE SAMPLES
RECOVERY: FOR 1 WEEK AT 65% RELATIVE HUMIDITY AND 23°C f.) PRECONDITIONING: 1 WEEK AT 65% RELATIVE HUMIDITY AND 23°C
STORAGE: WRINKLED FOR 1 WEEK UNDER LOAD AT ROOM TEMPERATURE
RECOVERY: FOR 1 WEEK AT 65% RELATIVE HUMIDITY AND 23°C

PRETREATMENT, PACKING, STORING AND FINISHING TREATMENT OF TEXTILE MATERIAL PRODUCTS

The present invention relates to a method for the pretreatment, packing, storing and finishing treatment of textile material products. In this method the moisture regain of the products is reduced, whereafter they are enveloped in packaging and the greater proportion of the air enclosed in the packages is removed and the packages are sealed.

Storing textile products has always been a problem due to their large propensity to wrinkle, with the necessary finishing treatment such as ironing and pressing resulting therefrom. The problem is especially prominent in transport, where the large space requirements of the products are very expensive to meet.

In an attempt to solve this problem, experiments have been made, before transport has taken place, to reduce the moisture content in the products, and thereafter enclose them in moisture-proof packages, whereafter the packages have possibly been evacuated. In this way transport of the products with less space requirements has been enabled. Crease formation has also been reduced, but has still been troublesome.

It has now been found that by carefully regulating the conditions for pretreatment, packing, storing and finishing treatment of textile material products, practically complete freedom from crease formation can be achieved. The products are hereby first brought to a moisture equilibrium corresponding to air with a relative humidity of 0–30% and a temperature of 25°C, in such a way that the products at the termination of this treatment have a temperature of at most 25°C. The products are subsequently enveloped in packaging made from a material with low water vapor permeability, after which the greater proportion of the air enclosed in the package is removed and the package is sealed. The products are subsequently stored or transported at a temperature of at most 30°C. When the products are to be used, the packages are opened and the products are reconditioned in an unloaded state at a relative humidity of at least 55% and a temperature of 20°–45°C, preferably at a relative humidity of at least 65% and a temperature of 20–45°C.

Especially advantageous results are obtained when the products are subjected to a first reconditioning step in an unloaded condition at a relative humidity of at most 35%, preferably at most 15% and a temperature of about 25°C, before the above-mentioned reconditioning.

By following the above-described method it is possible to obtain products which are practically without creases after long storage. The method is especially suitable in handling woollen goods, wool/polyester goods and other wool mixtures. Considerably reduced creasing in handling cotton or cotton mixture goods is also obtained, however.

Pretreatment is more effective the lower moisture equilibrium used. Suitably, the products are brought to a moisture equilibrium corresponding to air with a relative humidity of 0–15% and a temperature of at most 25°C. Wool is suitably brought to a moisture regain (= weight of water/product dry weight) of at most 5%.

Pretreatment can be carried out in several ways. For example, the products can be heated to reduce moisture content, with subsequent cooling to a temperature of at most 25°C, and conditioning for a substantial time at this temperature before packing. Most suitable is, however, to condition the products in air with the desired humidity and a temperature of at most 25°C. Suitable conditioning time is at least 1 day, preferably 3–7 days, room temperature suitably being used. Good air circulation during conditioning can reduce the necessary treatment time.

The products are thereafter enclosed in packaging consisting of material having low water vapor permeability, e.g. weldable plastic film. In order that the moisture regain of the products is not changed during storage, the amount of air enclosed in the packages during storing must be small in comparison to the absolute volume of the material. The greater portion of the air originally enclosed in the packages is therefore removed, for example by evacuation, whereafter the packages are moisture-proof-sealed.

So that the products will have a satisfactory appearance after finishing treatment, it is necessary that they are not exposed to too heavy temperature increases during storage and transport. Such a temperature increase can fix the creases which are obtained by the products being stowed in a cramped space during transport or storage. The temperature during this time should suitably be kept at under 30°C and preferably under 25°C. Especially good results are obtained at a storage temperature of about 5°C or lower.

When the products are to be used after transport or storage, the packages are opened and the products are reconditioned in an unloaded state at a relative humidity of at least 55%, preferably at least 65% and a temperature of 20°–45°C. The products are suitably first put through a reconditioning step at a relative humidity of at most 35%, preferably at most 15% and a temperature of about 25°C, whereafter they are reconditioned at the higher humidity mentioned above.

On reconditioning, the products are suitably removed from their packages and smoothed out or hung up in an atmosphere with the desired temperature and humidity. Already after about 24 hours at high humidity the products demonstrate a relatively crease-free appearance and after 1 week the treatment can usually be terminated. Reconditioning is preferably carried out first for 1 week with low humidity and subsequently for one week with high humidity.

BRIEF DESCRIPTION OF THE DRAWINGS:

In order that the invention may be more clearly understood, reference will now be made to the accompanying drawings wherein:

FIGS. 1 and 2 show the average values of the wrinkle heights of several woolen articles (per example 1) after wrinkling for 1 week and 3 weeks respectively, and after recovery for various time periods;

FIG. 3 shows the average values of the wrinkle heights of several woolen articles (per example 2) after various conditions of preconditioning, wrinkling, and recovery;

While referring to the attached drawings, some experiments with wrinkling of fabric samples will be described in the following. The experiments have been carried out to investigate the effect of different moisture and temperature conditions during pretreatment, storing and finishing treatment. FIGS. 1–5 show two-dimensional and FIGS. 6–8 three-dimensional diagrams of crease formation dependency on temperature and humidity during pretreatment, storing and finishing treatment.

Figure 4:
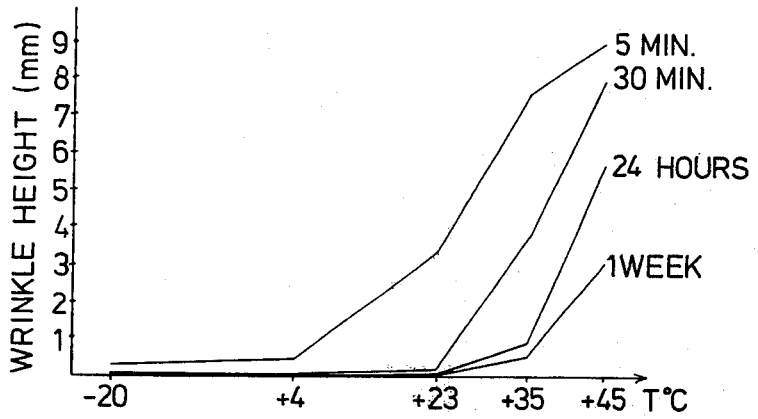
FIG. 4 shows the average values of the wrinkle heights of several woolen articles (per example 3) after wrinkling for 1 week at various temperatures, and after recovery for various time periods.

As a measurement of wrinkling, the wrinkling height after finishing treatment for a certain time has been taken. The wrinkle height is thereby measured as the height of the sample reduced by the thickness of the sample.

In Examples 1–3 and 5–6 the investigation was carried out on woollen material from 100% wool. In Example 4 both woollen and cotton materials were used. Before the investigations, the sample material was relaxed in water for 30 minutes at room temperature, subsequently thereto the webs were dried for 1 hour in tension frames at 70°C, whereafter sample pieces of 10 × 10 cm were stamped out. These sample pieces were subsequently reconditioned in the conditions given in the examples.

For wrinkling the samples a method of "conical wrinkling" (Example 6) and a method for "conical vacuum wrinkling" (Examples 1–5) were used. Conical wrinkling may be found described in "Wrinkle Recovery Properties of Cotton Fabrics at Changing Moisture and Temperature Conditons", SIRTEC, Symposium International de la Recherche Textile Cotonniere, Paris, April 22–25, 1969. In short, it was carried out according to the following.

A fabric sample was preconditioned and subsequently transferred during preconditioning conditions by means of a plastic frame and a rod to a Teflon cylinder, one end of which was quite open while the other end was closed with a perforated Teflon plate. The sample was larger than the inner diameter of the cylinder and was thus creased during its introduction therein. From the open end of the cylinder a piston, having two perforated Teflon plates with the same diameter as the inner diameter of the cylinder, was thereafter inserted in such a way that the upper Teflon plate was pressed against the sample. Thereafter the cylinder and piston were transferred to a climate box having the temperature and humidity desired during storage and finishing treatment. The cylinder rested on the upper piston plate. A load in communication with a circulation pump was thereafter placed on the cylinder, so that the sample was compressed between the perforated plate of the cylinder and the upper perforated piston plate, the pump being in communication with the perforated cylinder plate. Air with desired temperature and humidity was thereafter circulated through the sample.

The method for conical vacuum wrinkling is similar to that for conical wrinkling. In the conical vacuum wrinkling, sample pieces of fabric and tubes of writing block paper were preconditioned. Thereafter the sample pieces were transferred via a plastic frame with a metal rod to the paper tubes, the sample pieces being wrinkled. Each paper tube was thereafter placed in its own polyethylene plastic bag. The plastic bag was welded together with the exception of an outlet for connecting to a vacuum pump. A tube was taken down into the bag via the outlet, whereafter the pump was applied for withdrawing the air. Due to the negative pressure in the bag, the paper tube was flattened and thus the sample piece as well. After evacuation, a new and final weld was made in the bag so that the sample piece in its flattened and wrinkled condition was completely enclosed.

In conical wrinkling the humidity and temperature during wrinkling (storage) can thus be changed. In conical vacuum wrinkling, on the other hand, the sample retains the moisture content obtained during preconditioning during the whole of the storage, and only temperature can be varied.

EXAMPLE 1

Water relaxed samples of three woollen articles were conditioned for 1 week at 0, 15, 45, 65 and 93% relative humidity and room temperature. The samples were then vacuum wrinkled under loading at 23°C. After 1 week and 3 weeks, respectively, the packages were opened and the samples reconditioned for one week at 65% relative humidity and a temperature of 23°C.

The average values of the wrinkle heights of the three woollen articles after reconditioning for 30 minutes, 24 hours and 1 week are shown in FIGS. 1 and 2, FIG. 1 showing the wrinkle height after wrinkling for one week and FIG. 2 after wrinkling for 3 weeks.

It may be clearly seen from the figures that a relative humidity under 45% and preferably under 15% at room temperature is required for preconditioning.

EXAMPLE 2

Samples of pure wool articles were preconditioned at 15 and 65% relative humidity (23° ± 2°C) for 1 week. The samples were subsequently vacuum wrinkled under load for one week at room temperature.

The samples were reconditioned at 15 and 65% relative humidity at room temperature. The samples which had been reconditioned at 15% relative humidity for 1 week were conditioned thereafter for a further week at 65% relative humidity and room temperature.

The average values for the wrinkle height of three woollen articles is shown in the bar diagram in FIG. 3.

From the results it may be seen that recovery takes place quicker and better at 65% relative humidity than at 15%. Furthermore, the advantageous effect on recovery by preconditioning at low humidity is confirmed. Recovery during 1 week at 15% relative humidity and thereafter for 1 week at 65% also appears to give a better result than only recovery during one week at 65% relative humidity.

EXAMPLE 3

Samples of pure wool material were water relaxed, preconditioned for 1 week at 15% relative humidity and a temperature of 23°C and vacuum wrinkled.

The samples were loaded and subsequently stored during 1 week at temperatures of −20°, +4°, +23° and +45°C. Thereafter the samples were reconditioned at 65% relative humidity and a temperature of 23°C.

The wrinkle height (average value of three samples) after reconditioning for 5 minutes, 30 minutes, 24 hours and one week are shown in FIG. 4. It is apparent from the results that wrinkling is consolidated at a wrinkling temperature above 35°C. At wrinkling temperatures of 4°C and 23°C no remaining wrinkling effect seems to be obtained.

EXAMPLE 4

Samples of different textile materials were water relaxed and subsequently reconditioned at a relative humidity of 15% and 23°C. They were then vacuum wrinkled and loaded for 1 week at 23°C.

Figure 5:
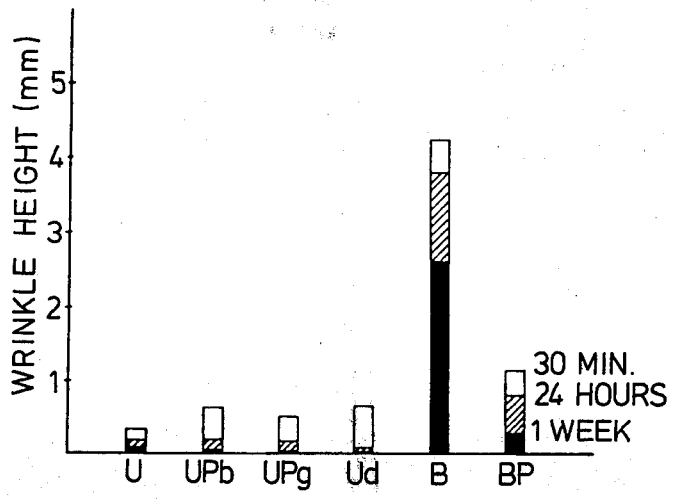
FIG. 5 shows the average values of the wrinkle heights of different textile materials (per example 4) each of which was subjected to identical preconditioning, wrinkling, and recovery conditions.

The wrinkle height of the samples, after recovery for 30 minutes, 24 hours and 1 week in a relative humidity of 65% and 23°C, is shown in the bar diagram in FIG. 5.

The different textile materials consisted of: U — 100% pure wool; UPb — wool/polyester (light goods); UPg — wool/polyester (heavy goods); Ud — 100% pure wool (double stretch); B — 100% pure cotton; BP — cotton/polyester.

As may be seen from the diagram, all the woollen articles had good recovery characteristics. On the other hand, the pure cotton article still had a considerable wrinkle height after 1 week's recovery. The cotton/polyester blended fabric recovered much better and wrinkled considerably less than the pure cotton one.

EXAMPLE 5

Pure wool samples were water relaxed and preconditioned for 24 hours at 15, 25, 35, 45, 55, 65, 75 and 85% relative humidity and at 23°C, whereafter they were vacuum wrinkled and placed under a load of 2 kp in a heating chamber at temperatures of 30°, 35°, 40°, 45°, 50° and 55°C, respectively. After 4 hours, the samples were taken out and reconditioned at 65% relative humidity and 23°C.

Figure 6:
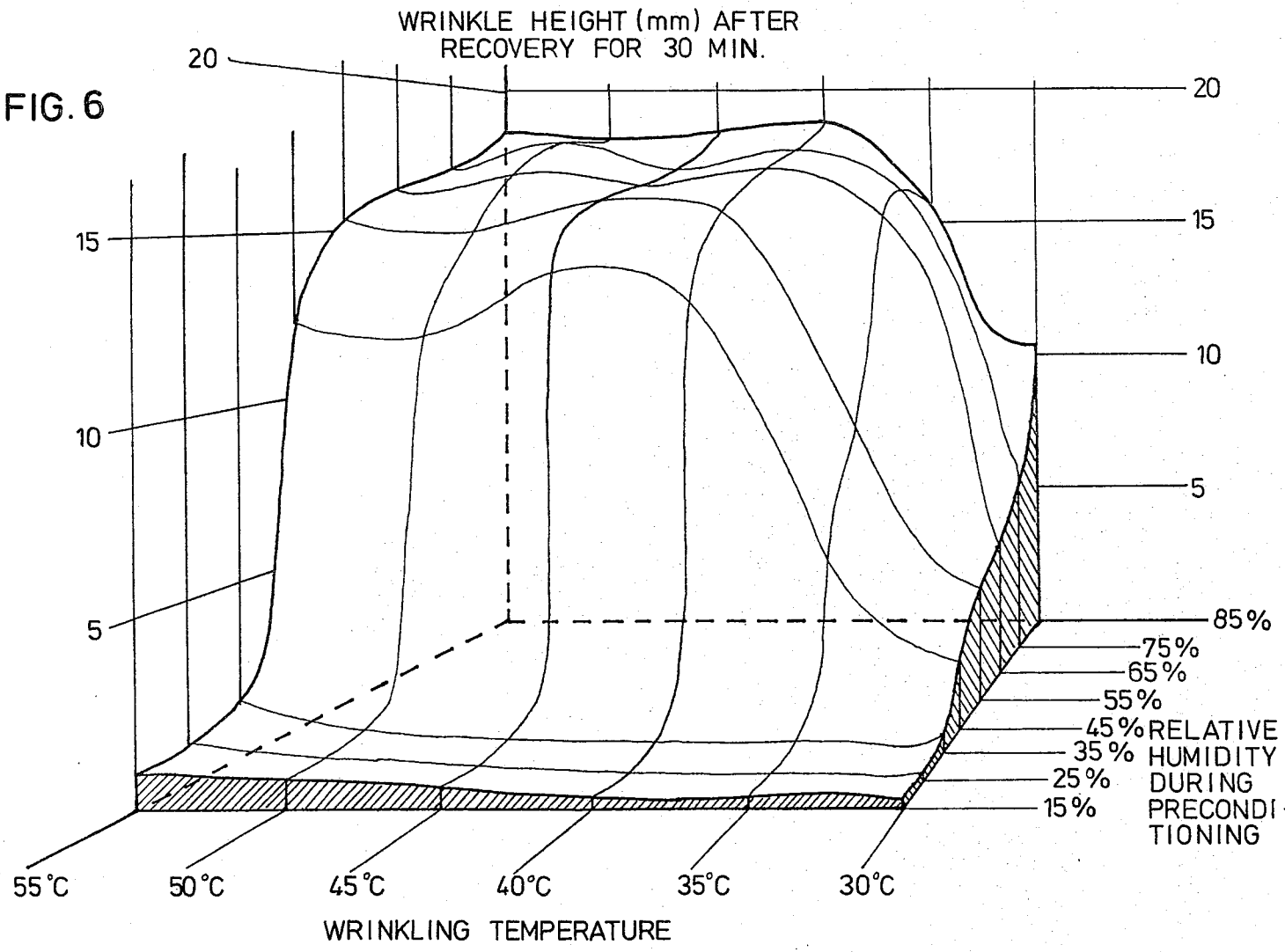
FIGS. 6 and 7 show the relationship of wrinkling temperature and preconditioning humidity to the average values of wrinkle heights (per example 5) after recovery for 30 minutes and 1 week, respectively, at a fixed relative humidity and temperature.
Figure 7:
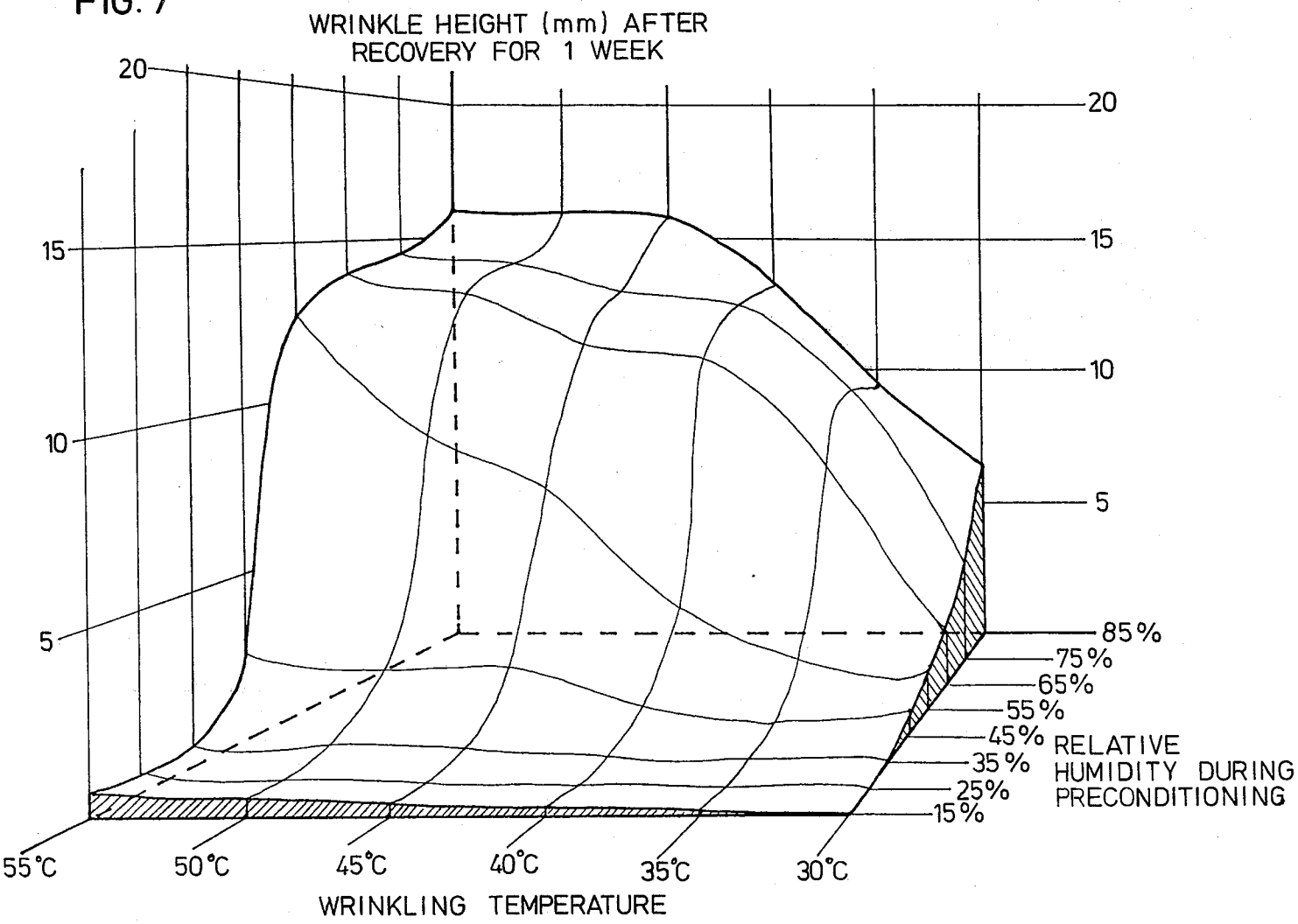

In FIGS. 6 and 7 the wrinkle heights are shown after recovery for 30 minutes and 1 week, respectively. The results demonstrate that greater wrinkle height is obtained both at higher temperature during storage and at higher humidity during preconditioning. There appears to be a critical value lying around 25–35% relative humidity for preconditioning.

EXAMPLE 6

Woollen samples were preconditioned at 65% relative humidity and 20°, 25°, 30°, 35°, 40° and 45°C for 24 hours, whereafter they were conically wrinkled for 10 minutes under a load of 2 kp. During wrinkling, air with a relative humidity of 65% and a temperature of 20°, 25°, 30°, 35°, 40° and 45°C was blown through the samples. The samples were then shaken out and reconditioned at the wrinkling temperature and wrinkling humidity.

Figure 8:
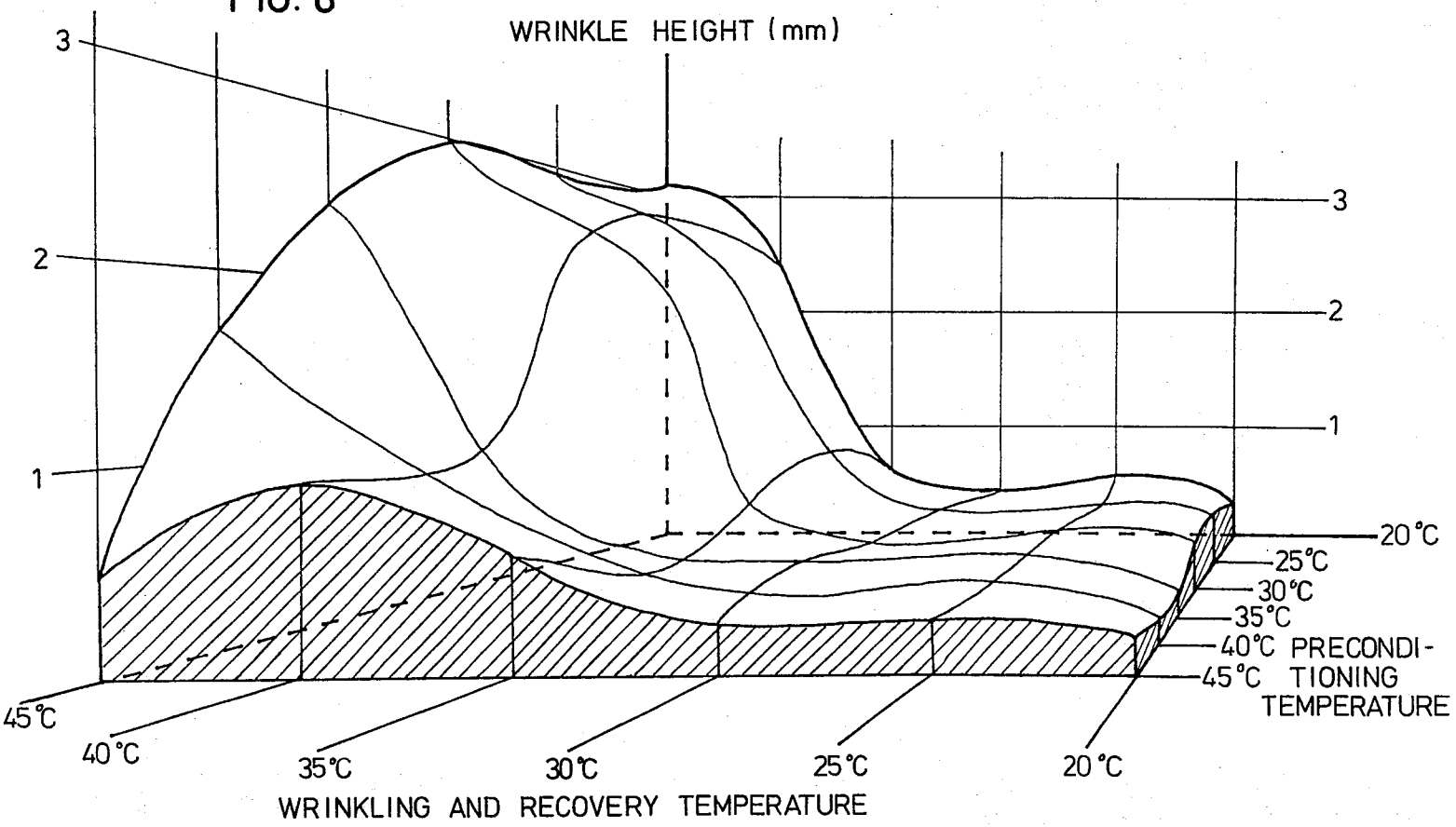
FIG. 8 is similar to FIG. 6, but shows the effects of further varying the reconditioning temperature and humidity on the average values of the wrinkle heights (per example 6).

The wrinkling heights after recovery for 30 minutes are shown in FIG. 8. It is apparent from the results that in general wrinkling increases for an increasing wrinkling temperature. At wrinkling temperatures between 20° and 30°C wrinkling is rather constant, but over 30°C there is an increase.

What we claim is:

1. A method for pretreatment, packing, storing and finishing treatment of a textile material product, the pretreatment comprising reducing the moisture content of the product followed by enclosing the product in a package made from a material having low water vapor permeability, wherefter the greater portion of the air contained in the package is removed therefrom and the package moisture-proof-sealed, wherein the product before enclosure in the package is brought to a moisture equilibrium with air at a relative humidity of 0–30% and at a temperature of 25°C, in such a way that the temperature in the product at the termination of this treatment does not exceed 25°C and that the packaged product after sealing the package is kept at a temperature of no higher than 30°C until the product is to be used, whereat the package is opened and the product is reconditioned in an unloaded state at a relative humidity of at least 55% and a temperature of 20—45°C.

2. A method as claimed in claim 1, wherein the product is brought to a moisture equilibrium with air having a relative humidity of 0–15% at 25°C before being enclosed in the package.

3. A method as claimed in claim 1, wherein the product at pretreatment is conditioned in air with a relative humidity of 0–30% and a temperature of no higher than 25°C, preferably with a relative humidity of 0–15% and 25°C.

4. A method as claimed in claim 1, wherein storage takes place at a temperature of no higher than 25°C.

5. A method as claimed in claim 1, wherein reconditioning takes place at a relative humidity of at least 65%.

6. A method as claimed in claim 1, wherein prior to reconditioning the product is preliminarily reconditioned in an unloaded state at a relative humidity no higher than 35% and a temperature of 25°C.

7. A method as claimed in claim 6, wherein the preliminary reconditioning takes place at a relative humidity no higher than 15%.

* * * * *